United States Patent [19]

Luke

[11] 4,036,114

[45] July 19, 1977

[54] APPARATUS FOR CIGARETTE FILTER MANUFACTURE

[75] Inventor: John Anthony Luke, Romsey, England

[73] Assignee: Brown & Williamson Tobacco Corporation, Louisville, Ky.

[21] Appl. No.: 709,346

[22] Filed: July 28, 1976

[30] Foreign Application Priority Data

Aug. 11, 1975 United Kingdom ..... 33430/75

[51] Int. Cl.[2] ..... A24C 5/50; B05C 5/02

[52] U.S. Cl. ..... 93/1 C; 118/68; 118/411

[58] Field of Search ..... 427/265; 118/223, 219, 118/68, 224, 222, 67, 221, 410, 411, 65, 419, 420; 156/90; 93/1 C, 77 FT

[56] References Cited

U.S. PATENT DOCUMENTS

| | | | |
|---|---|---|---|
| 2,149,896 | 6/1939 | McArdle et al. | 118/223 X |
| 2,170,140 | 8/1939 | Grupe | 118/224 X |
| 2,868,685 | 1/1959 | Downs et al. | 156/90 |
| 3,563,781 | 2/1971 | Johnson | 427/265 X |
| 3,844,199 | 10/1974 | Block et al. | 93/1 C |

*Primary Examiner*—Morris Kaplan
*Attorney, Agent, or Firm*—William J. Mason

[57] ABSTRACT

The invention relates to an apparatus for treating porous wrapping material for a smoking article, for example a cigarette filter. According to the invention, the porous material is provided, by coating with a film-forming substance, with an impervious region or regions positioned to coincide with a region or regions at which adhesive is to be applied, the said substance being dried or set before such adhesive is applied. Thus, a line or lines of the film-forming substance may be applied to the same face of the wrapping material as a line or lines of adhesive for sealing the wrap and/or anchoring filtering material thereto, namely to that face which will be on the inside of the wrap formed from the said material.

3 Claims, 2 Drawing Figures

APPARATUS FOR CIGARETTE FILTER MANUFACTURE

Figure 1:
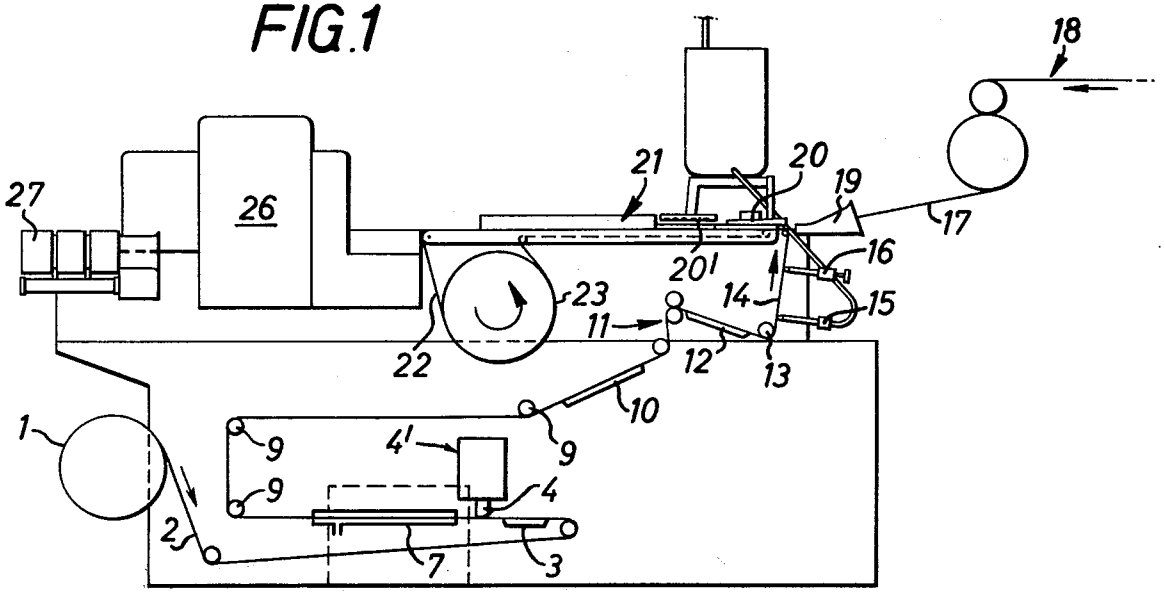

This invention concerns improvements relating to porous wraps or wrapping materials for smoking articles, particularly plug or filter wraps.

It is known to wrap cigarette filters in paper which is provided with perforations or which is highly porous. The production of filter rods wrapped in this kind of paper presents problems, for example due to seepage of seam adhesive which is applied to the paper. The adhesive passes through the holes or pores and contaminates the reverse face of the paper. When the filter material together with the paper enters the usual garniture, adhesive on that face, which at this stage becomes the underface and then the outer face of the paper wrap, comes into contact with the case and tongue or short and long folders of the garniture. Some adhesive, even if now solidified, rubs off and, together with chalk dust which is usually present in the paper, forms a build-up. This results in an obstruction and causes tears in the paper, leading to stoppage of the machine. It is an object of the present invention to achieve an improved porous wrap in which, particularly, filter rods can be wrapped without such difficulties.

According to the invention, in an apparatus for the treatment of porous wrapping material for a smoking article, the said material is provided with an impervious region or regions by applying a coating of a film-forming substance at a region or regions positioned to coincide with a region or regions at which adhesive is to be applied, which substance is dried or set before such adhesive is applied. The film-forming substance seals off pores in the porous wrapping material, normally a porous paper, and prevents penetration of the adhesive through that material. The film-forming substance need be applied to one face of the material only, preferably the face which is on the inside of the completed wrap.

The region or regions of adhesive may be a line or lines of adhesive for producing the wrap seam and/or for anchoring filtering material to the wrapping material. The line or lines of film-forming substance should have a width or widths at least equal to the width or respective widths of the line or lines of adhesive, but preferably have a slightly greater width or widths.

The film-forming substance, in addition to being chemically stable in relation to the adhesive substance or substances subsequently applied, should also be flexible to permit of subsequent manipulation of the wrapping material and is preferably of a nature such that it dries rapidly, as this permits of higher operating speeds of wrapping apparatus employed. Suitable film-forming substances may be selected from heat-drying or air-drying types. Suitble film-forming substances dried by the application of heat are synthetic polymers such as polyvinyl alcohol or ethylene vinyl acetate, cellulose derivatives, for example ethyl-, methyl-, and carboxy methyl cellulose, acrylates, and natural gums such as gelatines, alginates, dextrins and starch. Suitable substances which can be air-dried are extruded thermoplastics such as polyethylene and polypropylene. The film-forming substance may be in liquid form or in the form of an emulsion or may be applied as a melt produced from a powder or fine granules. advantageously film-forming substances with a melting point in the range of 90°–130° C., preferably as low as possible, are selected. For example, polyethylene melts at about 90° C. and ethylene vinyl acetate at about 110° C.

The film-forming substance may be applied by means of an applicator nozzle or nozzles by which it is deposited on the wrapping material which is in the form of a web, in a continuous line or lines. If two or more lines are to be provided, a single nozzle with two or more nozzle orifices may be employed. The coated wrapping material is then passed through a drying region which will incorporate heating means if a heat-drying type of film-forming substance is employed. Beyond this region, the wrapping material may be fed over two or more rollers which have circumferential grooves in positions corresponding with the positions of the lines of film-forming substance in order to prevent contamination by the latter. On its approach to a nozzle or nozzles for applying adhesive, the wrapping material is preferably guided over flat guides set to the width of the material and positioned laterally to ensure registration between the lines of film-forming substance already applied and of adhesive to be applied.

According to a modification, one line of film-forming substance applied as described above may be utilized for sealing the wrapping material, in which case the application of a line of other adhesive for this purpose can be dispensed with. This line of film-forming substance can be re-activated, to ensure adhesion, by heat applied in the garniture.

A preferred manner of carrying out the invention will now be described, by way of example, with reference to the accompanying drawings, in which:-

Figure 2:
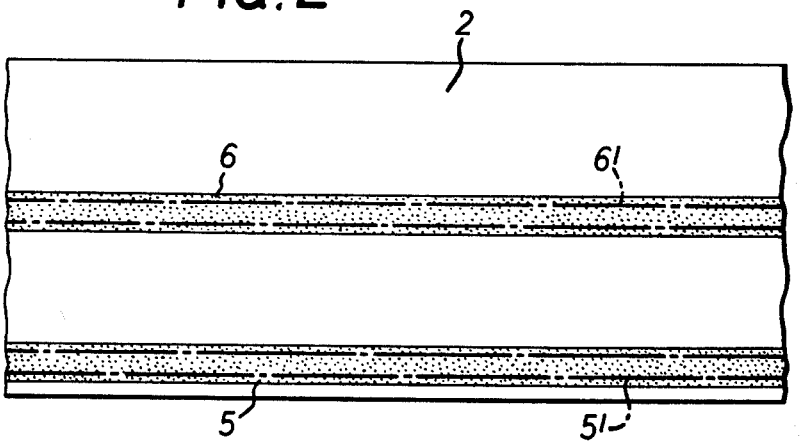

FIG. 1 is a diagrammatic side elevation of a complete cigarette-filter wrapping apparatus, and FIG. 2 is a plan view of a short length of wrapping paper.

A web of porous filter-wrapping paper 2 drawn from a bobbin 1 is continuously moved longitudinally over a flat guide 3 and under a device 4 for applying to one face of the web a narrow line or lines of film-forming substance extending in the longitudinal direction of the web. The device 4 may be a standard form of applicator such as is used for the application of adhesive to paper in the cigarette industry. Depending upon the type of film-forming substance used, it may be fed to the applicator 4 from a reservoir 4' by gravity and/or under pressure, if necessary with the application of heat. The applicator 4 will have one or more of nozzle orifices depending upon the numbers of lines to be produced, two lines 5, 6, in the case illustrated by FIG. 2, namely a line 5 corresponding in position to a line 5' of seam adhesive to be applied and a line 6 corresponding to a line 6' of filter-anchoring adhesive. The paper is held under slight tension below the applicator 4, in order to obtain good control of the positioning of the lines of coating applied. A suitable width of line is 3mm and a suitable thickness of coating is obtained with a rate of application of 5 to 20 g/90 meter of paper. For the line 5 in particular, this rate should be set, within the aforesaid range, to suit the amount of adhesive later to be applied, which may vary in practice.

The web 2 next traverses a drying region whose nature will depend upon the type of film-forming substance used. With a heat-drying substances, for example ethylene vinyl acetate a drying unit 7 heated by conventional means, for example steam or electricity, is employed. With an air-drying substances, for example poyethylene, the web may be simply exposed to ambient air while it passes over rollers in an unheated drying region. In each case, the drying region must be adequately long to ensure effective drying at the speed of advance of web, corresponding to the speed of operation of the filter-rod producing apparatus, which is desirably made as high as possible.

Beyond the drying region, the web 2 is carried over two or more rollers 9, each provided with annular grooves corresponding in number, spacing and width to the lines of applied substance, two lines in the example of FIG. 3, to avoid contamination of the roller surfaces by the said substance.

The web then passes over a flat guide 10, through a set of feed rollers 11, over a flat guide 12 and around a roller 13 before entering a substantially vertical flight 14 where a line or lines of adhesive are applied to the face of the web 2 carrying the film-forming substance at locations corresponding to the lines of film-forming substance already applied. In the example of FIG. 2, there are two such lines of adhesive. One line 5', corresponding to the line 5, near one edge of the web for subsequently sealing together the overlapping edges of the web to form the wrap seam and the other line 6', corresponding to the line 6, approximately at the mid width of the web serves for anchoring the filter material, hereinafter referred to, to the wrap. Suitably the lines of adhesive 5', 6' are each 1½to 2mm wide approximately, which is slightly less, say by at least 0.5mm, than the width of the lines 5, 6 of film-forming substances, the former lines being substantially centrally located in relation to the latter lines. Normal adhesives may be employed. If required, different adhesives, for example a hot melt adhesive or polyvinyl acetate for the seam and cellulose acetate dissolved in triacetin and polyvinyl acetate for the filter anchorage, may be used.

The guides 10 and 12 are set to the width of the web 2 and are positioned, transversely of the web, to ensure the aforesaid relationship between the lines 5, 6 and the lines 5', 6' applied by the applicators 15, 16.

For providing the filter material to be wrapped, a tow 17 of cellulose acetate, for example, is applied in known manner from a tow processing unit 18 through a collecting funnel 19 to a garniture in which a web 2, becomes wrapped around the tow. This garniture may comprise, in well known manner, a tongue 20, a short folder 20' and a long folder 21 through which the web is carried with the assistance of an endless garniture tape 22 driven by an expansible drum 23. The wrap seam becomes sealed in known manner. The wrapped filter rod is then passed to apparatus 26 in which, in known manner, it is cut into lengths which are collected at 27.

For some purposes, it may be preferred to provide, in known manner, two lines of adhesive, one close to each edge of the web 2, for forming the wrap seam. In this case, instead of the single line 5 of film-forming substance, there would be two such lines correspondingly close to respective edges of the web, as well as the intermediate line 6.

In some cases, it may be advantageous to wind the treated wrapping material on a bobbin for storage and subsequent use. The precoated material could be produced at a higher speed than the speed of production of filter rod wrapped with the material.

EXAMPLE

A filter rod of cellulose acetate is to be formed in the usual manner on a filter-rod maker and wrapped in a highly porous paper having a porosity of 300,000 $cm^3 min^{-1} (10\ cm\ WG)^{-1} (10\ cm^2)^{-1}$.

The paper is fed, as described above, from a bobbin past an applicator fitted with a nozzle which has two orifices of 2mm diameter at a distance apart of 12mm. The paper, 27mm wide, is fed through a guide disposed so that the centres of the orifices are located at 2mm and 14mm from one edge of the paper. Polyethylene powder is used for the film-forming substance. The applicator is heated and the polyethylene, in the form of a melt, is deposited under pressure onto the paper, producing lines thereof 3mm wide at 2mm and 14mm centre distance from the edge respectively. The paper is thereafter guided through a drying region in which it passes over grooved rollers, for example four follers spaced 60mm apart, so as to allow the polyethylene to dry. The rollers are provided with two circumferential grooves corresponding in position to the positions of the lines of polyethylene, so that the roller surfaces do not come into contact with any polyethylene which has not dried. The coated paper is passed through a flat guide in advance of applicator nozzles for seam adhesive and filter-anchorage adhesive. This guide is adjusted so that the centres of the adhesive lines coincide with the centres of the respective lines of polyethylene. The width of the lines of adhesive is 1½ to 2mm.

An ethylene-vinyl acetate copolymer emulsion may be applied as the film-forming substance in substantially the same manner, except that heating means is provided in a drying region following the applicator for the film-forming substance.

I claim:

1. In an apparatus for forming cigarette filter rods in which a filter material in the form of a processed tow and a porous filter wrapping paper are each directed along a perdetermined pathway from a supply source to a garniture for combination thereat, said apparatus including a said garniture, means feeding said tow from said supply, through a collector funnel and to said garniture, and an adhesive applicator means positioned along said pathway intermediate said supply source and said garniture and being adapted to apply adhesive to a predetermined area on said paper, the improvement comprising a. an additional applicator means positioned along said pathway intermediate said supply source and said adhesive applicator means, said additional applicator means being adapted to apply a film-forming material to a predetermined area of said paper and being positioned a sufficient distance from said adhesive applicator means to permit drying of said film-forming material to an impervious film prior to said film-forming material reaching said adhesive applicator means;

b. guide means for guiding said paper to said adhesive applicator means, whereby said adhesive is applied to a predetermined area coinciding with the area covered by said impervious film; and c. means guiding said adhesive coated paper to said garniture to effect wrapping of the paper about said tow.

2. The apparatus of claim 1, further comprising a drier means positioned along said pathway intermediate said additional applicator means and said adhesive applicator means for facilitating drying said film-forming material.

3. The apparatus of claim 1, wherein said predetermined area is a continuous line extending longitudinally along said paper.

* * * * *